US008936333B2

(12) United States Patent
Turner

(10) Patent No.: US 8,936,333 B2
(45) Date of Patent: Jan. 20, 2015

(54) APPLIANCE AND A RACK ASSEMBLY FOR THE SAME

(71) Applicant: General Electric Company, Schenectady, NY (US)

(72) Inventor: Darren Allen Turner, Louisville, KY (US)

(73) Assignee: General Electric Company, Schenectady, NY (US)

( * ) Notice: Subject to any disclaimer, the term of this patent is extended or adjusted under 35 U.S.C. 154(b) by 86 days.

(21) Appl. No.: 13/773,958

(22) Filed: Feb. 22, 2013

(65) Prior Publication Data

US 2014/0239788 A1 Aug. 28, 2014

(51) Int. Cl.

| | |
|---|---|
| ***A47B 81/00*** | (2006.01) |
| ***F24C 15/16*** | (2006.01) |
| *A47B 96/02* | (2006.01) |

(52) U.S. Cl.

CPC ..... *F24C 15/16* (2013.01); *A47B 96/025* (2013.01)

USPC ..... 312/410; 312/306; 126/337 A

(58) Field of Classification Search

CPC ..... A47B 88/0451; A47B 2210/0059; F24C 15/16; F24C 15/162; F24C 15/168

USPC ..... 312/410, 408, 325, 302, 303, 266, 312/270.2; 126/337 A, 337 R, 332, 339

See application file for complete search history.

(56) References Cited

U.S. PATENT DOCUMENTS

| | | | | | |
|---|---|---|---|---|---|
| 999,633 | A | * | 8/1911 | Cramer | 126/337 A |
| 1,352,352 | A | * | 9/1920 | Caswell | 126/337 A |
| 1,533,256 | A | * | 4/1925 | McCaul | 126/337 A |
| 1,851,182 | A | * | 3/1932 | Hill | 126/337 A |
| 2,069,706 | A | | 2/1937 | Gerwig et al. | |
| 2,106,506 | A | * | 1/1938 | Pletcher et al. | 126/339 |
| 2,114,697 | A | * | 4/1938 | Babin | 126/337 A |
| 2,477,305 | A | * | 7/1949 | Leighton | 126/339 |
| 2,480,250 | A | * | 8/1949 | Klemme | 126/41 E |
| 2,641,247 | A | * | 6/1953 | Genebach | 126/337 A |
| 2,804,068 | A | * | 8/1957 | Miller et al. | 126/337 R |
| 3,188,161 | A | * | 6/1965 | Powder | 312/306 |
| 3,403,581 | A | | 10/1968 | Harness | |
| 4,046,019 | A | | 9/1977 | Phillips | |
| 4,151,753 | A | | 5/1979 | F'Geppert | |
| 5,429,043 | A | * | 7/1995 | Becker | 126/337 A |
| 2010/0237132 | A1 | | 9/2010 | Measamer et al. | |

FOREIGN PATENT DOCUMENTS

| | | | | | |
|---|---|---|---|---|---|
| JP | 04306421 | A | * | 10/1992 | F24C 15/16 |

* cited by examiner

*Primary Examiner* — Hanh V Tran
(74) *Attorney, Agent, or Firm* — Dority & Manning, P.A.

(57) ABSTRACT

A rack assembly for an appliance includes a geared rack and a pair of gears. The gears of the pair of gears mesh with each other and the geared rack. The rack assembly also includes a shelf and a support link that couples that shelf to at least one of the pair of gears. The geared rack and pair of gears can assist with selectively adjusting a vertical height of the shelf.

20 Claims, 9 Drawing Sheets

APPLIANCE AND A RACK ASSEMBLY FOR THE SAME

FIELD OF THE INVENTION

The present subject matter relates generally to appliances, such as oven appliances, and rack assemblies for the same.

BACKGROUND OF THE INVENTION

Appliances such as refrigerator appliances and oven appliances generally include one or more shelves or racks for supporting food items, containers, and/or cooking utensils. For example, oven appliances conventionally include one or more racks whereon multiple food items can be supported within the oven appliance during operation of the oven appliance. In order to accommodate food items and cooking utensils of different sizes, certain oven appliances include horizontal protrusions formed on side walls of the oven appliance's chamber. Racks can slide into and out of the oven appliance's chamber on such horizontal protrusions. In particular, the racks and protrusions are designed so that a user can remove a rack from protrusions at one vertical level and reinstall the rack at a different vertical level, which the user may select based on e.g., the height of the food items or utensils, the number of items being cooked, the type of food being cooked, and/or other factors. Similarly, certain refrigerator appliances have shelves that e.g., include tabs or hooks at a rear of the shelves. Such shelves can be unhooked and moved to various vertical locations.

However, such conventional designs can present challenges to appliance users. For example, certain user may find removal and reinstallation of the rack or shelf at various vertical heights cumbersome or difficult. Additionally, in certain oven appliances, the protrusions are formed by stamping metal sheets to form side walls of the oven appliance's chamber. Due to such construction, the number of vertical levels can be limited to e.g., only four or five within the oven appliance's chamber. Thus, the amount of vertical adjustability can be quite limited and, therefore, unsatisfactory to some users. Similar problems can exist with shelving systems in refrigerator appliances.

Other systems have been proposed to provide vertical adjustability for the racks or shelves within an appliance. Typically, however, such constructions are also limited to fixed number of a relatively few locations at which the racks or shelves can be placed within the appliance. Some constructions may also be limited in the amount of weight that can be supported.

Accordingly, an appliance having vertically adjustable racks or shelves would be useful. An appliance also having features that allow for an increased selection of vertical locations to which the racks or shelves can be adjusted would also be useful. Further, an appliance having features that allow for quick and easy adjustment of the racks or shelves to the various vertical locations would be useful.

BRIEF DESCRIPTION OF THE INVENTION

The present subject matter provides an appliance and a rack assembly for the same. The rack assembly includes a geared rack and a pair of gears. The gears mesh with each other and the geared rack. The rack assembly also includes a shelf and a support link that couples that shelf to at least one of the pair of gears. The geared rack and pair of gears can assist with selectively adjusting a vertical height of the shelf. Additional aspects and advantages of the invention will be set forth in part in the following description, or may be apparent from the description, or may be learned through practice of the invention.

In a first exemplary embodiment, a rack assembly for an appliance is provided. The rack assembly defines a lateral direction and a vertical direction. The lateral and vertical directions are perpendicular to each other. The rack assembly includes a shelf for supporting food items and cooking utensils and a geared rack that extends along the lateral direction. A pair of gears is positioned adjacent the geared rack. The gears mesh with each other and the geared rack. A support link extends between and couples at least one of the pair of gears to the shelf.

In a second exemplary embodiment, an appliance is provided. The appliance defines a vertical direction, a lateral direction, and a transverse direction. The vertical, lateral, and transverse directions are mutually perpendicular. The appliance includes a cabinet having interior walls that define a chamber. The interior walls of the cabinet include sidewalls that are spaced apart from each other along the transverse direction. A shelf assembly is positioned within the chamber of the cabinet. The shelf assembly includes a support feature mounted to the cabinet at one of the sidewalls of the cabinet and a geared rack mounted to the support feature. The geared rack extends along the lateral direction. A pairs of gears is positioned adjacent the geared rack. The gears mesh with each other and the geared rack. The shelf assembly also includes a shelf for supporting items thereon. A support link couples at least one of the pair of gears to the shelf.

In a third exemplary embodiment, a rack assembly for an appliance is provided. The rack assembly defines a vertical direction and a lateral direction that are perpendicular to each other. The rack assembly includes a shelf for supporting food items and cooking utensils and a shelf adjustment assembly for supporting the shelf at various positions along the vertical direction. The shelf adjustment assembly includes a geared rack that extends along the lateral direction and a pair of gears positioned adjacent the geared rack. The gears mesh with each other and the geared rack.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
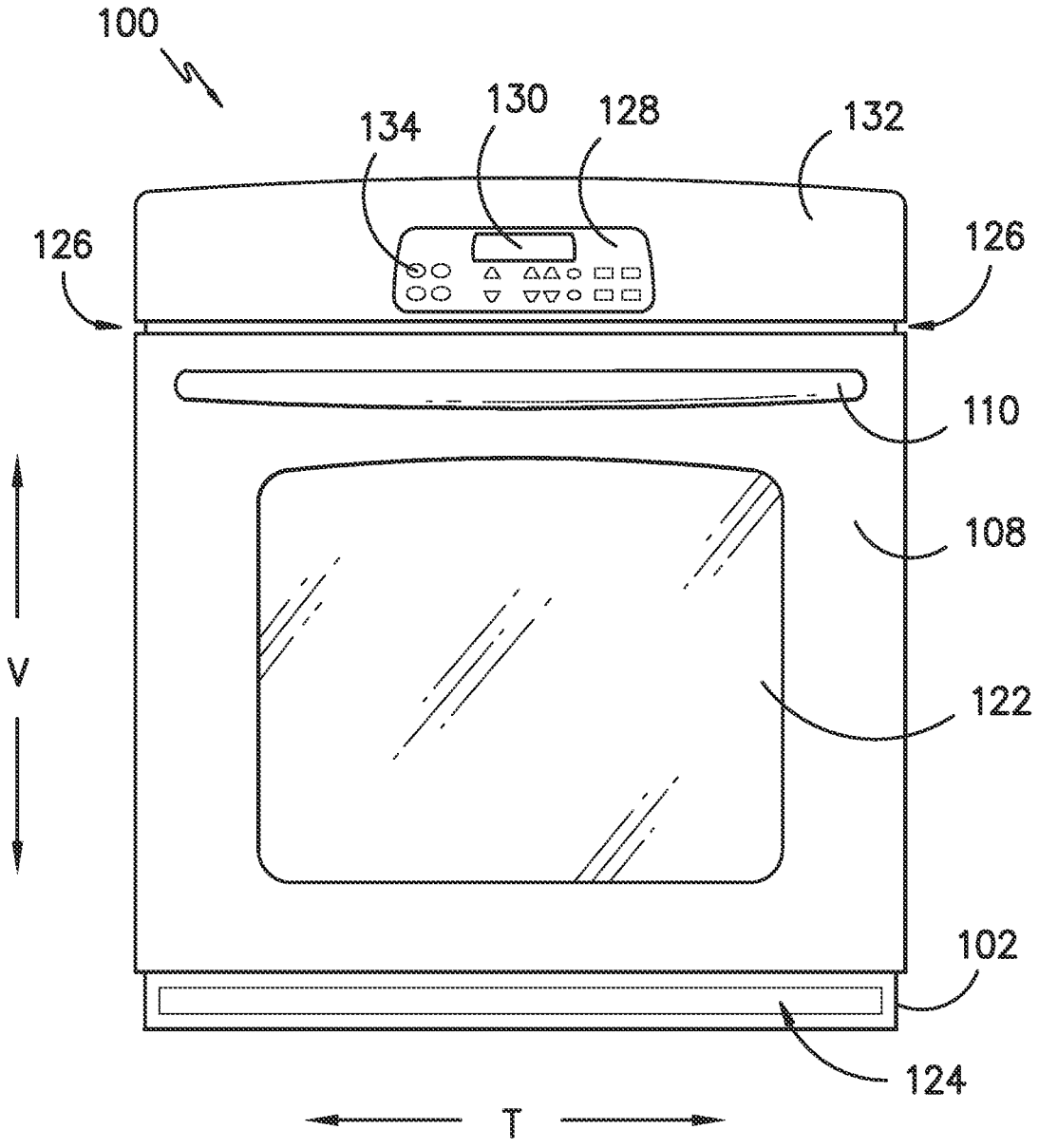
FIG. 1 provides a front, elevation view of an oven appliance according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
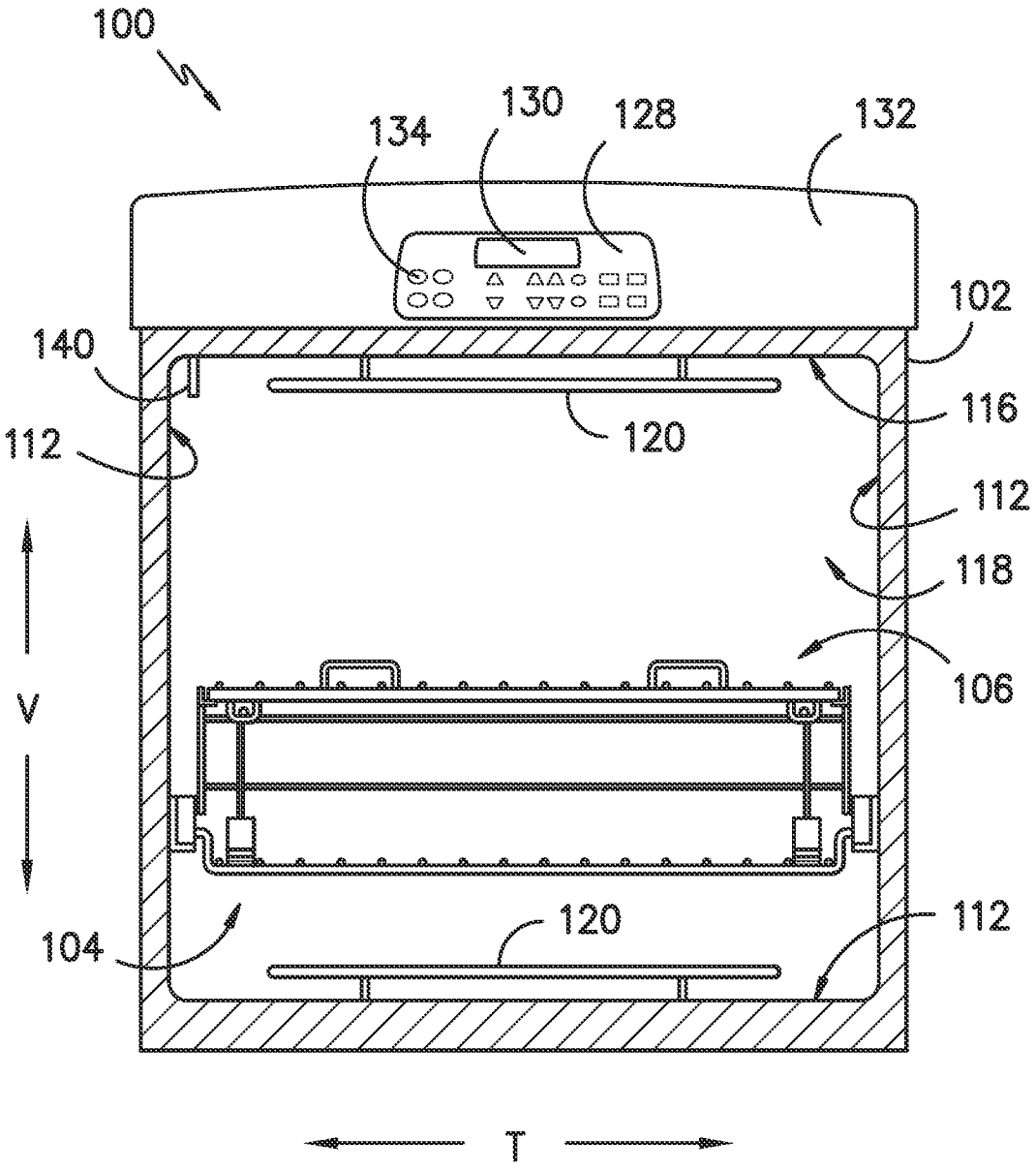
FIG. 2 provides a front, partial section view of the exemplary oven appliance of FIG. 1 and an exemplary shelf assembly positioned with a cooking chamber of the oven appliance.

FIG. 1 provides a front, elevation view of an oven appliance 100 according to an exemplary embodiment of the present subject matter. FIG. 2 provides a front, partial section view of oven appliance 100 and a vertically adjustable shelf assembly 106 positioned with a cooking chamber or oven cavity 104 of oven appliance 100. Oven appliance 100 defines a vertical direction V, a lateral direction L (FIG. 3), and a transverse direction T. The vertical, lateral, and transverse direction V, L, and T are mutually perpendicular and form an orthogonal direction system.

Oven appliance 100 includes a cabinet 102 that defines a cooking chamber or cavity 104 into which shelf assembly 106 is installed. Oven appliance 100 also includes a door 108 with handle 110 that provides for opening and closing access to oven cavity 104 through an opening at the front of cavity 104. A user of the oven appliance 100 can place a variety of different items to be cooked in oven cavity 104, which is defined by interior walls of cabinet 102, such as a pair of opposing side walls 112, a bottom wall 114, a top wall 116, and a rear wall 118. Opposing sidewalls 122 are spaced apart from each other, e.g., along the transverse direction T. Bottom wall 114, top wall 116, and rear wall 118 extend between and connect opposing side walls 112, e.g., along the transverse direction T. Shelf assembly 106 is positioned with oven cavity 104 for supporting food items and/or cooking utensils thereon.

Heating elements 120 are positioned at bottom wall 114 and top wall 116 of chamber 104 to provide heat for cooking and cleaning. Such heating element(s) can be any suitable heating element such as, e.g., gas heating elements, electric heating elements, microwave heating elements, or any suitable combination thereof. A window 122 on door 108 allows the user to view e.g., food items during the cooking process. For purposes of cooling, inlet 124 allows for an inflow of ambient air into a ventilation system while vent 126 allows for the outflow of such air after it has been heated by oven appliance 100.

Oven appliance 100 includes a user interface 128 having a display 130 positioned on top panel 132 with a variety of controls 134. Interface 128 allows the user to select various options for the operation of oven appliance 100 including e.g., temperature, time, and/or various cooking and cleaning cycles. Operation of oven appliance 100 can be regulated by a controller (not shown) that is operatively coupled i.e., in communication with, user interface panel 128, heating element(s), and other components of oven appliance 100 as will be further described.

For example, in response to user manipulation of the user interface panel 128, the controller can operate one or more heating element(s). The controller can receive measurements from a temperature sensor 140 placed in oven cavity 104 to e.g., provide a temperature indication to the user with display 130. By way of example, the controller may include a memory and one or more processing devices such as microprocessors, CPUs or the like, such as general or special purpose microprocessors operable to execute programming instructions or micro-control code associated with operation of appliance 100. The memory may represent random access memory such as DRAM, or read only memory such as ROM or FLASH. In one embodiment, the processor executes programming instructions stored in memory. The memory may be a separate component from the processor or may be included onboard within the processor.

The controller may be positioned in a variety of locations throughout appliance 100. In the illustrated embodiment, the controller may be located under or next to the user interface 128 or otherwise within top panel 132. In such an embodiment, input/output ("I/O") signals are routed between the controller and various operational components of appliance 100 such as heating element(s), controls 134, display 130, sensor(s), alarms, and/or other components as may be provided. In one embodiment, the user interface panel 132 may represent a general purpose I/O ("GPIO") device or functional block.

Although shown with touch type controls 134, it should be understood that controls 134 and the configuration of appliance 100 shown in FIG. 1 is provided by way of example only. More specifically, user interface 128 may include various input components, such as one or more of a variety of electrical, mechanical or electro-mechanical input devices including rotary dials, push buttons, and touch pads. The user interface 128 may include other display components, such as a digital or analog display device designed to provide operational feedback to a user. The user interface 128 may be in communication with the controller via one or more signal lines or shared communication busses.

It should be understood that oven appliance 100 is provided by way of example only. Thus, the present subject matter can also be in any other suitable appliance. Thus, although oven appliance 100 is shown in FIGS. 1 and 2 as a wall oven, the present subject matter can also be utilized in or with any other suitable appliance such as, e.g., a stand-alone oven appliance, an oven appliance with a stove-top, and non-oven appliances as well.

Figure 3:
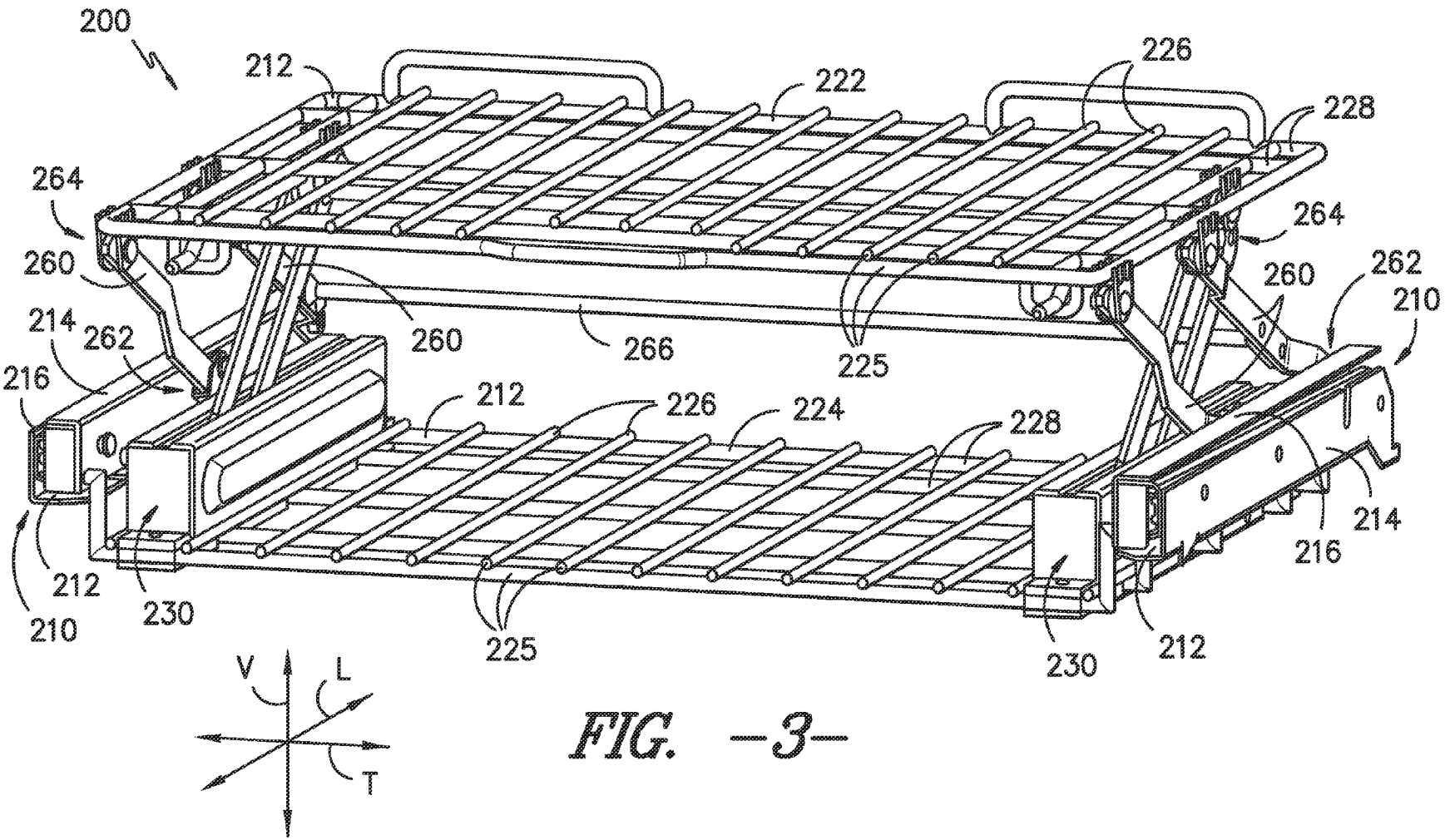
FIG. 3 provides an elevation view of a rack assembly according to an exemplary embodiment of the present subject matter.
Figure 4:
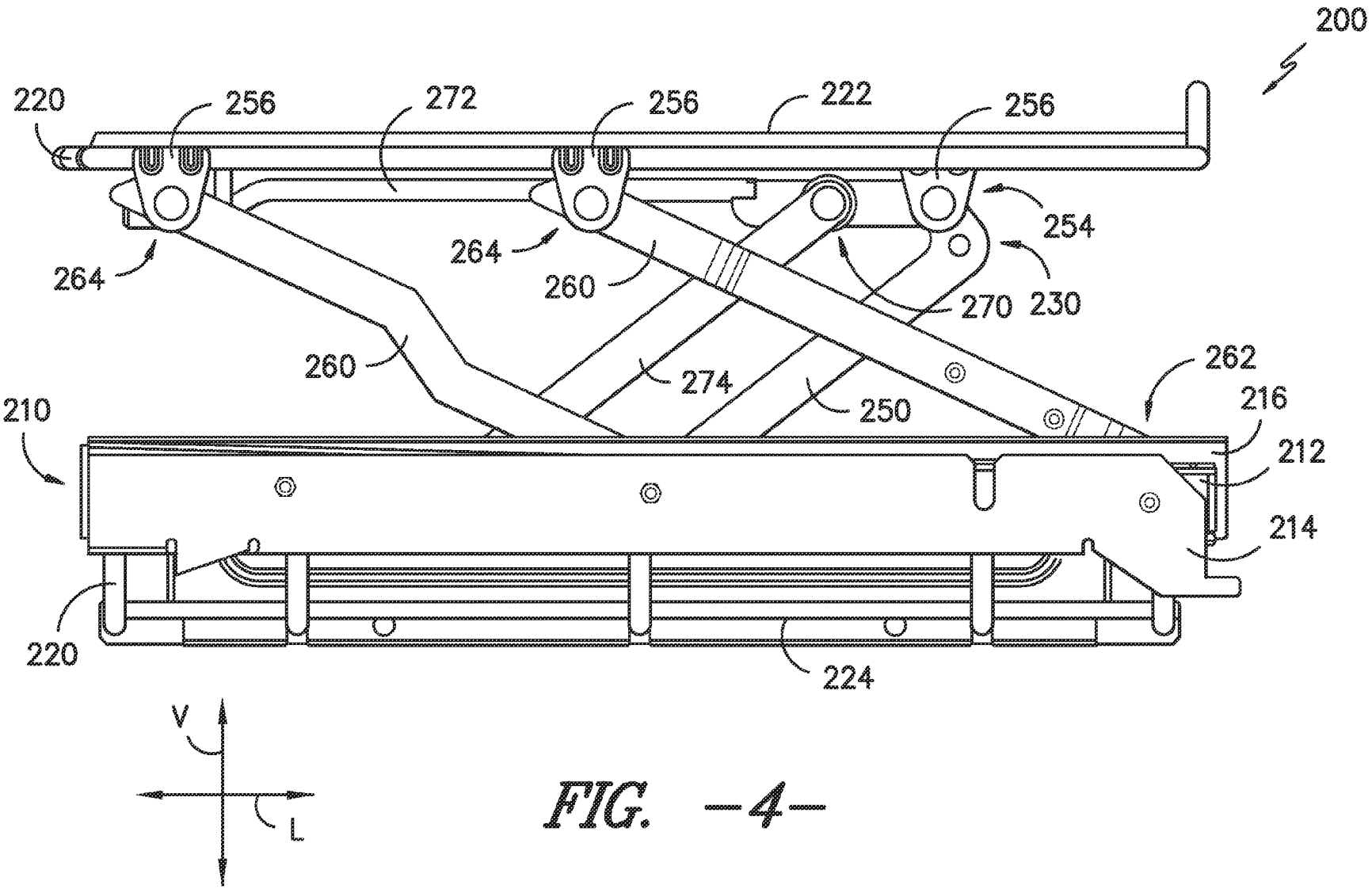
FIG. 4 provides a side, elevation view of the exemplary rack assembly of FIG. 3.

FIG. 3 provides an elevation view of a rack assembly 200 according to an exemplary embodiment of the present subject matter. FIG. 4 provides a side, elevation view of rack assembly 200. Rack assembly 200 can be utilized in any suitable appliance. As an example, rack assembly 200 may be positioned within oven cavity 104 of oven appliance 100 (FIG. 2) and utilized as shelf assembly 106. Rack assembly 200 may also be utilized or positioned within a refrigerator appliance, a freezer appliance, a dryer appliance, etc.

Rack assembly 200 includes mounting features 210. Mounting features 210 can assist with mounting rack assembly 200 within or on an appliance. In particular, mounting features 210 can assist with mounting rack assembly 200 within oven cavity 104 of oven appliance 100. Each one of mounting features 210 may be positioned adjacent and mounted to a respective one of opposing sidewalls 112. Thus, mounting features 210 are spaced apart from each other, e.g., along the transverse direction T such that mounting features 210 are positioned on opposite transverse sides of rack assembly 210 relative to each other.

Mounting features 210 can be secured to opposing sidewalls 112 in any suitable manner. For example, fasteners, such as screws, bolts, etc., can secure mounting features 210 to opposing sidewalls 112. In alternative exemplary embodiments, opposing sidewalls 112 can defines slots at various vertical heights as will be understood by those skilled in the art. Mounting features 210 may slide into such slots in order to assist with securing mounting features 210 to opposing sidewalls 112.

In the exemplary embodiment shown in FIGS. 3 and 4, mounting features 210 are shown as slide assemblies 212. Slide assemblies 212 each have a fixed portion 214 and a sliding portion 216. Fixed portion 214 may be secured or mounted to one of opposing sidewalls 112. Conversely, sliding portion 216 is slidably mounted to fixed portion 214, e.g., such that sliding portion 216 is movable along the lateral direction L relative to fixed portion 214. In such manner, slide assemblies 212 can permit rack assembly 200 to slide into and out of oven cavity 104 of cabinet 102. It should be understood that in alternative exemplary embodiments, mounting features 210 can be any other suitable mechanism for mounting or securing rack assembly 200 within or on an appliance. For example, mounting features 210 may be brackets or braces.

Rack assembly 200 also includes shelves 220. Shelves 220 can assist with supporting food items and/or cooking utensils within oven chamber 104 of cabinet 102. As may be seen in FIG. 3, shelves 220 include various elongated members 225, such as wires. In particular, shelves 220 include a plurality of transversely spaced members 226 and a plurality of laterally spaced members 228 that are fixed to one another in order to from a lattice structure for supporting food items and cooking utensils thereon. However, it should be understood that shelves 220 are not limited to assemblies of elongated members 225 and may include shelves constructed from other materials such as expanded metal, sheet metal, and others.

Shelves 220 are spaced apart from each other, e.g., along the vertical direction V. In particular, shelves 220 include a first shelf 222 and a second shelf 224 that are spaced apart from each other, e.g., along the vertical direction V such that first shelf 222 is positioned above second shelf 224. Second shelf 224 is, e.g., directly, mounted to mounting feature 210, e.g., sliding portion 216 of slide assembly 212. Conversely, bracing links 260 couple first shelf 222 to mounting feature 210, e.g., sliding portion 216 of slide assembly 212.

Bracing links 260 are rotatably mounted to mounting feature 210 and first shelf 222 in order to couple mounting feature 210 to first shelf 222. In particular, each link of bracing links 260 extends between a first end portion 262 and a second end portion 264. First end portions 262 of bracing links 260 are rotatably mounted to mounting feature 210. Conversely, second end portions 264 of bracing links 260 are rotatably mounted to first shelf 222. Thus, bracing links 260 extend between first shelf 222 to mounting feature 210 and couple first shelf 222 to mounting feature 210. In certain exemplary embodiments, bracing links 260 can be about the same length between first and second end portions 262 and 264 of bracing links 260, e.g., such that first and second shelves 222 and 224 remain substantially parallel to each other in the vertical direction V during rotation of bracing links 260. Cross bars 266 extend, e.g., along the transverse direction T, between bracing links 260 on opposite sides of rack assembly 200. Cross bars 266 assist with stabilizing rack assembly 200 and, e.g., hindering movement of first shelf 222 along the transverse direction T.

Rack assembly 200 also includes a shelf adjustment assembly or vertical adjustment assembly 230. Vertical adjustment assembly 230 is configured for permitting a user of rack assembly 200 to adjust a position of first shelf 222, e.g., relative to second shelf 224, along the vertical direction V. Vertical adjustment assembly 230 is discussed in greater detail below.

Figure 5:
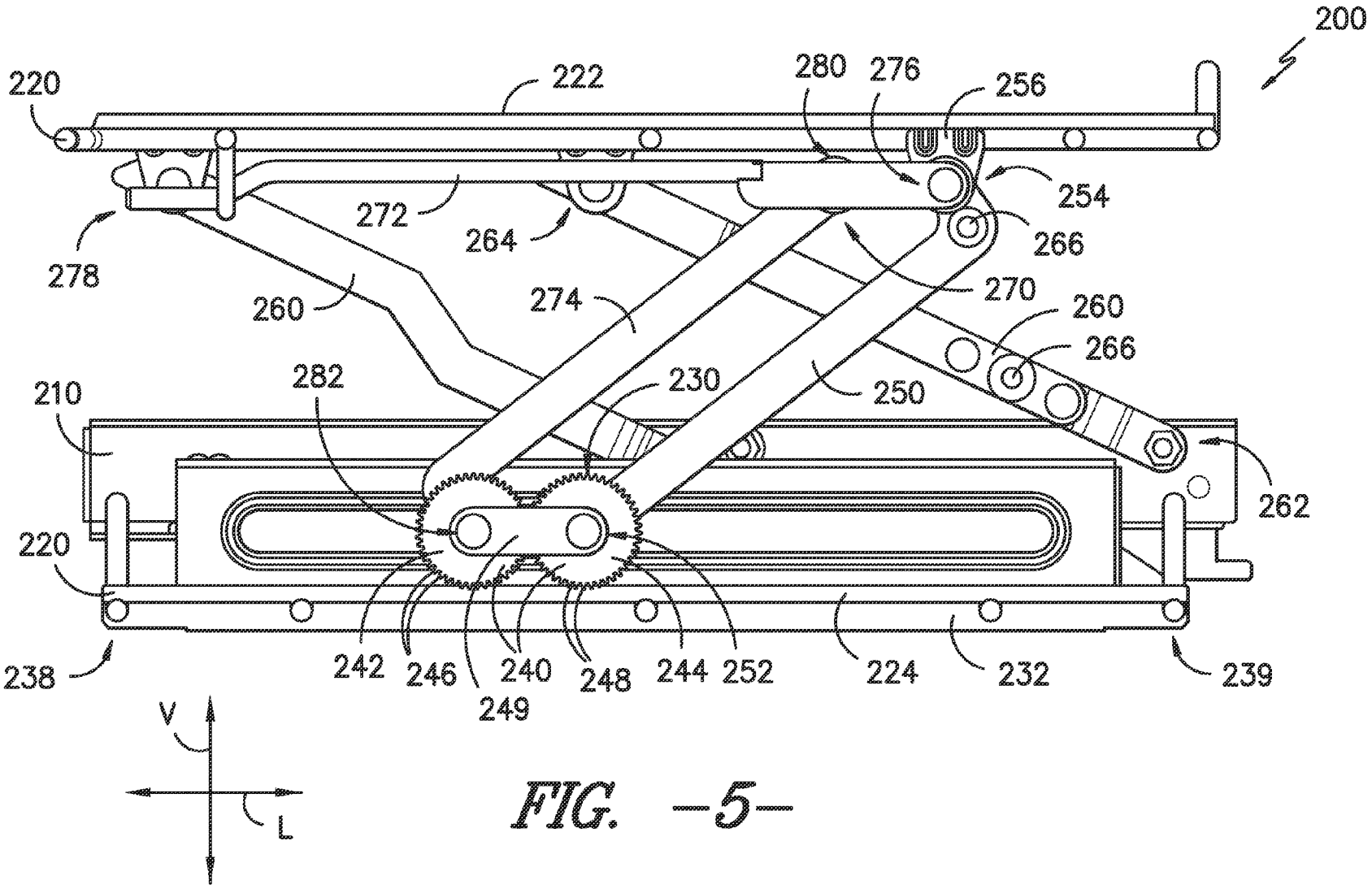
FIG. 5 provides a side, section view of the exemplary rack assembly of FIG. 4.
Figure 6:
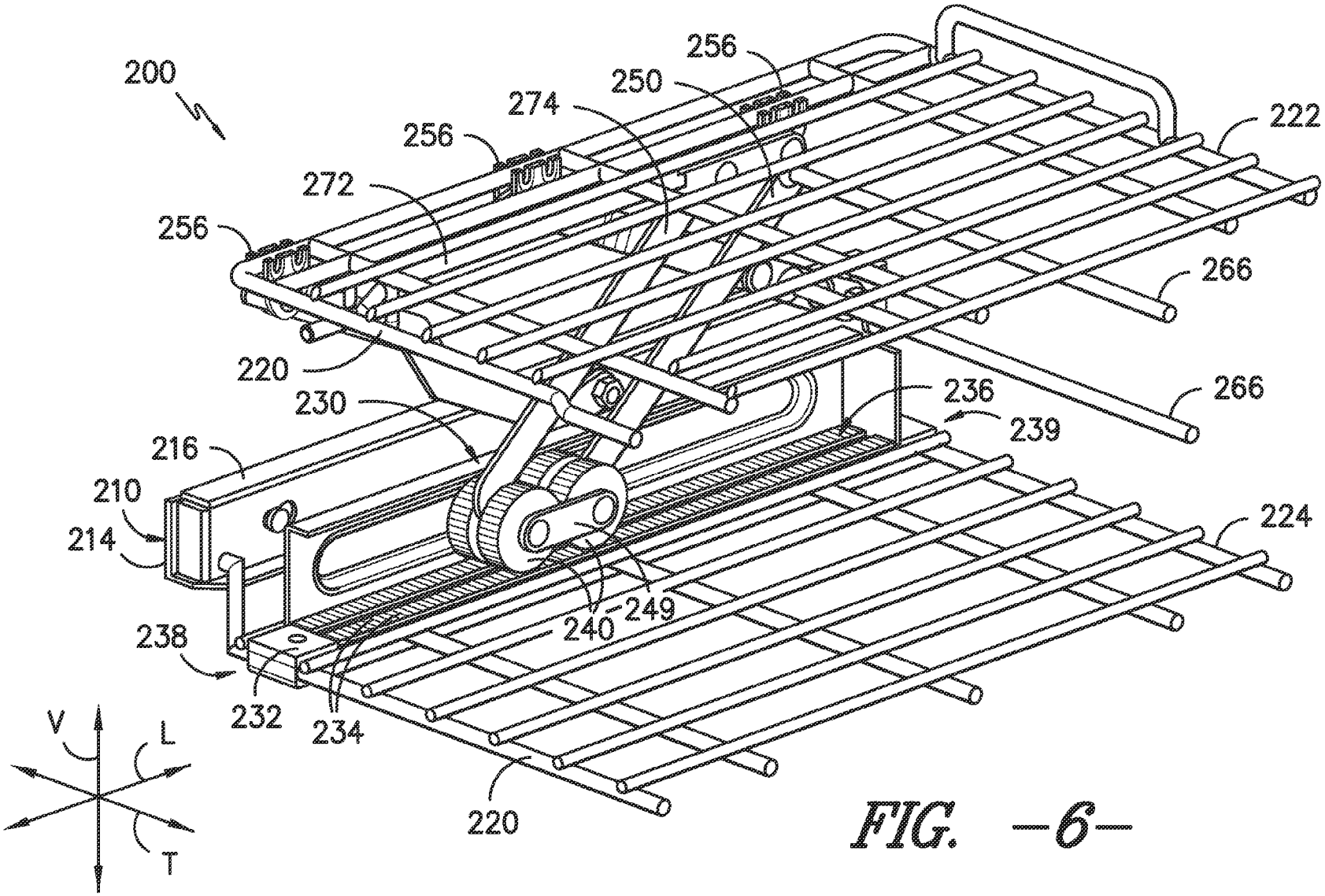
FIG. 6 provides a perspective, section view of the exemplary rack assembly of FIG. 3.

FIG. 5 provides a side, section view of rack assembly 200. FIG. 6 provides a perspective, section view of rack assembly 200. As may be seen in FIG. 6, vertical adjustment assembly 230 includes a linear gear or geared rack 232. Geared rack 232 extends, e.g., linearly, along the lateral direction L between a first end portion 238 and a second end portion 239. Thus, first and second end portions 238 and 239 of geared rack 232 are spaced apart from each other, e.g., along the lateral direction L. Geared rack 232 is mounted to second shelf 224 such that geared rack 232 is spaced apart from first shelf 222, e.g., along the vertical direction V. By mounting geared rack 232 to second shelf 224, geared rack 232 is also coupled or mounted to mounting feature 210.

Geared rack 232 includes a plurality of teeth 234. In particular, geared rack 232 includes a top surface 236 that, e.g., faces first shelf 222. Teeth 234 of geared rack 232 are positioned at top surface 236 of geared rack 232. Teeth 234 of geared rack 232 are spaced apart from each other, e.g., along the lateral direction L. Thus, teeth 234 of geared rack 232 are distributed or dispersed along the lateral direction L on top surface 236 of geared rack 232.

Vertical adjustment assembly 230 also includes a pair of, e.g., circular, gears 240. Gears 240 are positioned adjacent each other and geared rack 232. In particular, gears 240 mesh with each other and geared rack 232 in order to assist with selectively positioning first shelf 222 along the vertical direction V, e.g., relative to second shelf 224, as discussed in greater detail below. A coupling link 249 extends between gears 240 and couples gears 240 together such that gears 240 mesh with each other. Thus, coupling link 249 can hinder movement of gears 240 away from each other, e.g., along the lateral direction L.

A support link 250 extends between and couples at least one of gears 240 to first shelf 222. In particular, support link 250 is rotatably mounted to the at least one gears 240 and to first shelf 222. Support link 250 extends between a first end portion 252 and a second end portion 254. First end portion 252 of support link 250 is rotatably mounted to the at least one gears 240, and second end portion 254 of support link 250 is rotatably mounted to first shelf 222. In particular, clips 256 assist with rotatably mounting second end portion 254 of support link 250 is rotatably mounted to first shelf 222.

Vertical adjustment assembly 230 also includes an actuator assembly 270. Actuator assembly 270 includes a lever or handle 272 and a connector link 274. Handle 272 is rotatably mounted to first shelf 222. In particular, handle 272 extends between a distal end 278 and a proximal end 276. Handle 272 is rotatably mounted to first shelf 222 at proximal end 276 of handle 272. Connector link 274 extends between and couples at least one gear of gears 240 to handle 272, e.g., at or adjacent proximal end 276 of handle 272. In particular, connector link 274 extends between a first end portion 280 and a second end portion 282. First end portion 280 of connector link 274 is rotatably mounted to handle 272. Conversely, second end portion 282 of connector link 274 is rotatably mounted to the at least one gear of gears 240.

As discussed in greater detail below, actuator assembly 270 is configured for assisting a user with selectively disengaging at least one gear of gears 240 from geared rack 232. Thus, actuator assembly 270 can assist a user of rack assembly 200 with selectively positioning first shelf 222 along the vertical direction V, e.g., relative to second shelf 224.

Figure 7:
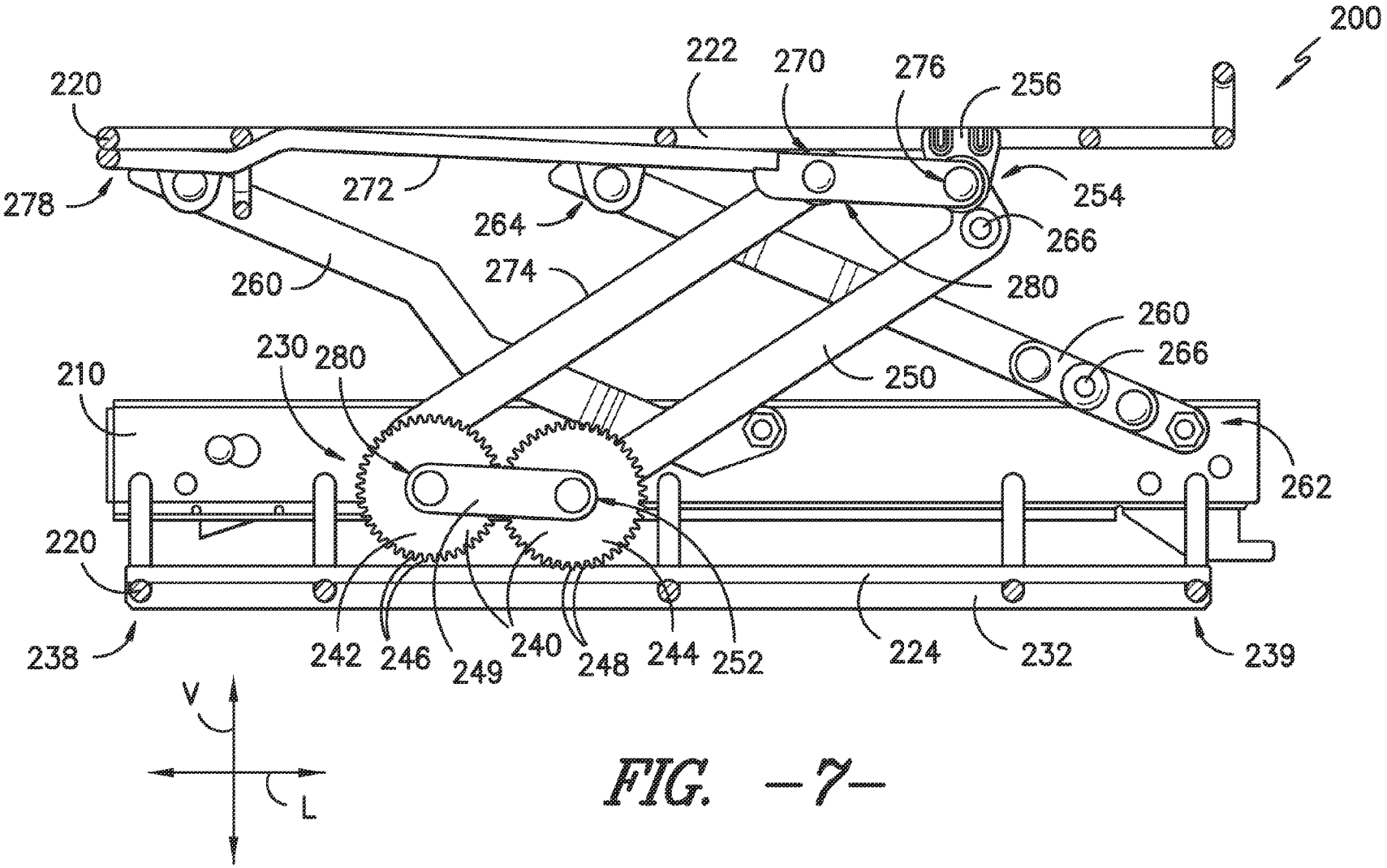
FIGS. 7, 8, and 9 provide section views of the exemplary rack assembly of FIG. 3 with a shelf of the rack assembly shown in various vertical positions.
Figure 8:
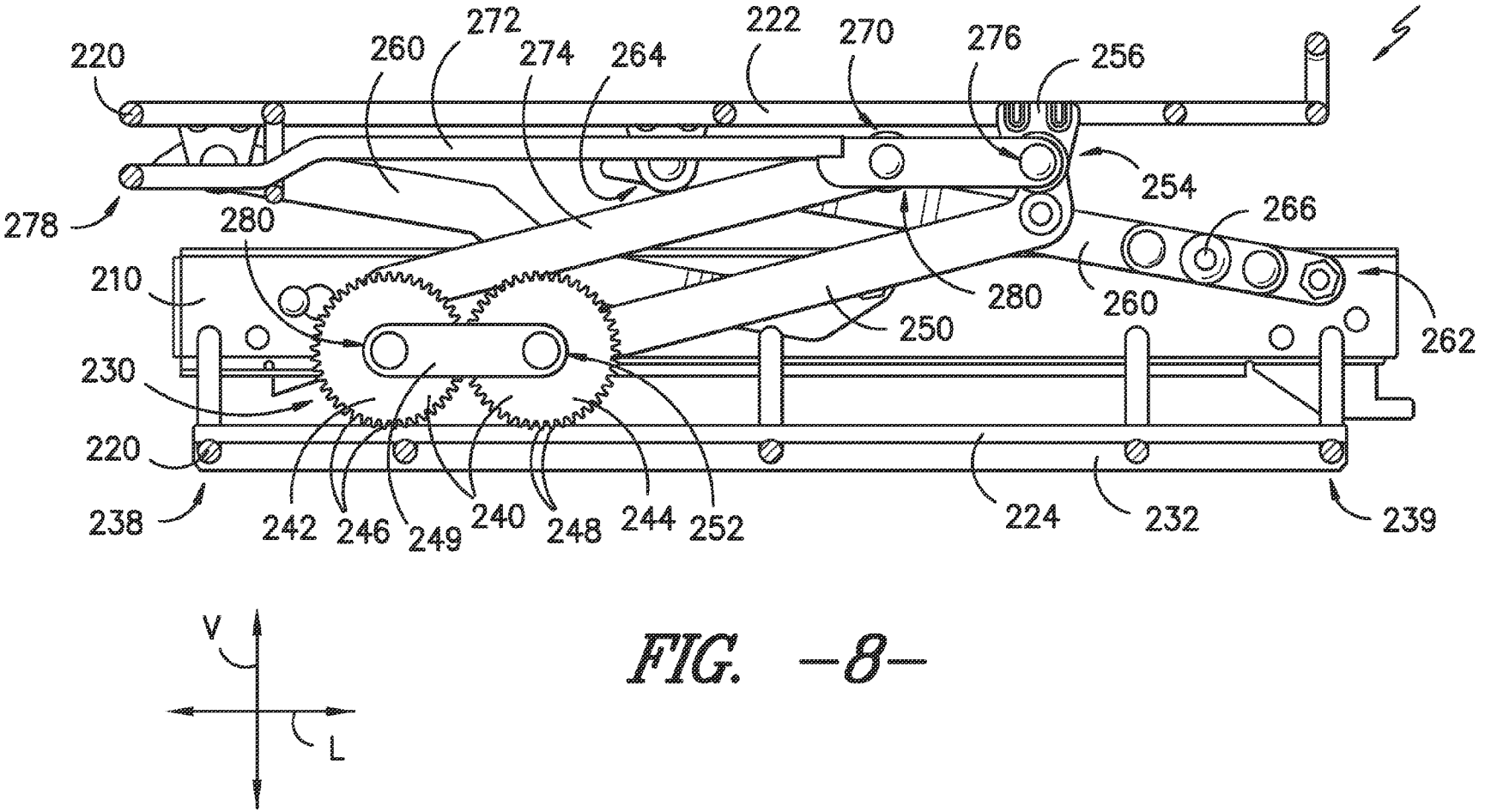
Figure 9:
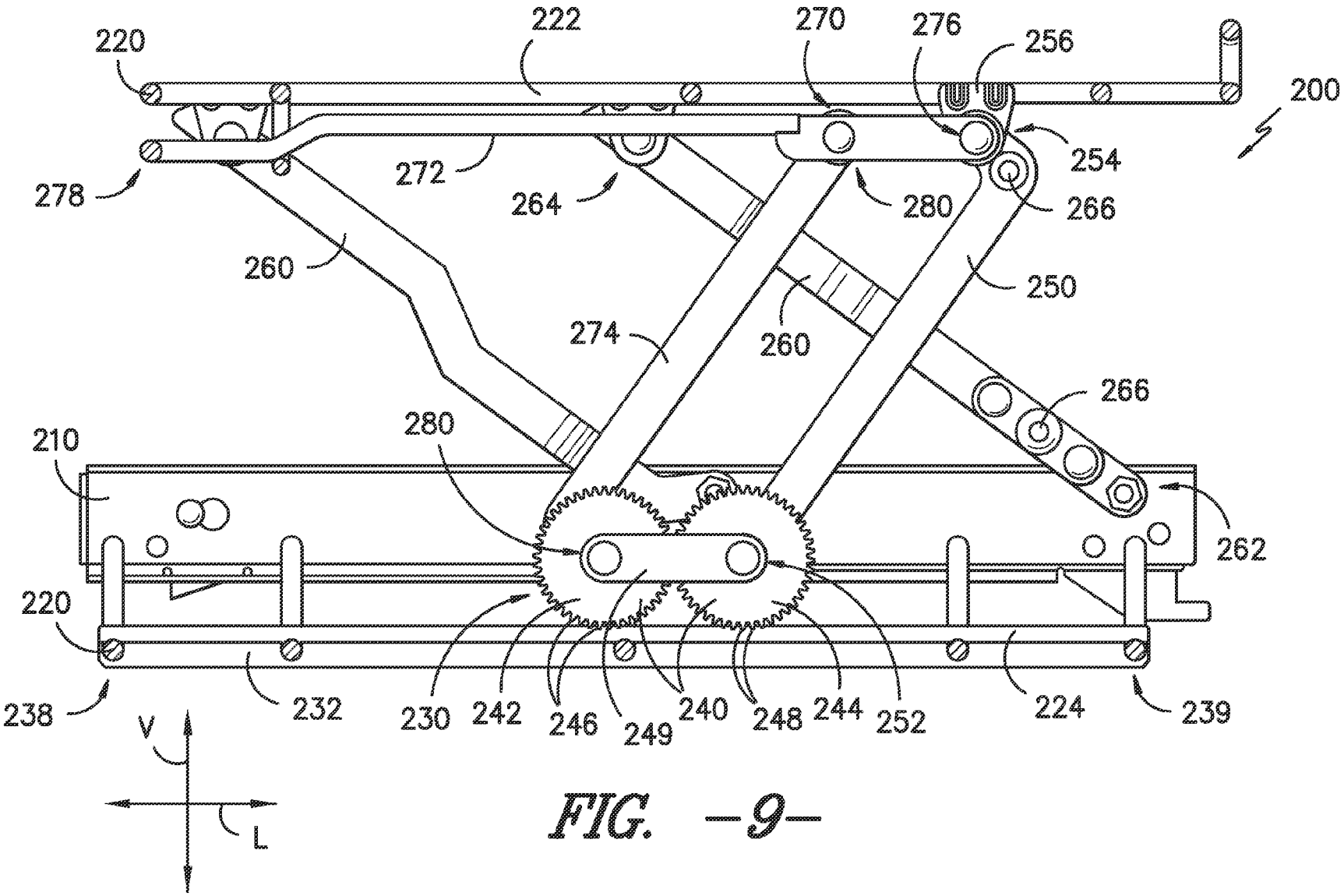

FIGS. 7, 8, and 9 provide section views of rack assembly 200 with first shelf 222 of rack assembly 200 shown in various vertical positions. As an example, a user of rack assembly 200 can adjust first shelf 222 from the vertical position shown in FIG. 5 by lifting upwardly on handle 272, e.g., distal end 278 of handle 272, as shown in FIG. 7. With handle 272 lifted upwardly, connector link 274 lifts at least one gear of gears 240 off of geared rack 232. Thus, the at least one gear of gears 240 is not meshed with geared rack 232 when the user lifts handle 272.

In particular, gears 240 include a first gear 242 and a second gear 244. First gear 242 includes a set of teeth 246, and second gear 244 also includes a set of teeth 248. When the user lifts handle 272, connector link 274 lifts first gear 242 off of geared rack 232 such that teeth 246 of first gear 242 are not meshed with teeth 234 of geared rack 232. However, teeth 246 of first gear 242 can remain meshed with teeth 248 of second gear 244 with handle 272 lifted, e.g., due to coupling link 249.

With first gear 242 not meshed with geared rack 234, the user can drop first shelf 222 downwardly to the position shown in FIG. 8, or the user can lift first shelf 222 upwardly to the position shown in FIG. 9. With first shelf 222 positioned at a suitable location, the user can release handle 272 such that connector link 274 permits first gear 242 to mesh with geared rack 232. When first and second gears 242 and 244 are meshed with each other and with geared rack 232, vertical adjustment assembly 230 supports first shelf 222 and hinders first shelf 222 from moving, e.g., downwardly, along the vertical direction V. In particular, vertical adjustment assembly 230 supports first shelf 222 and hinders first shelf 222 from moving, e.g., downwardly, along the vertical direction V when teeth 246 of first gear 242 engage teeth 248 of second gear 244 and teeth 234 of geared rack 232 and teeth 248 of second gear 244 also engage teeth 234 of geared rack 232. Conversely, when either teeth 246 of first gear 242 and/or teeth 248 of second gear 244 and are not meshed with teeth 234 of geared rack 232, first shelf 222 can be repositioned upwardly or downwardly along the vertical direction V. In such a manner, vertical adjustment assembly 230 can assist a user of rack assembly 200 with adjusting a position of first shelf 222, e.g., relative to second shelf 224, along the vertical direction V.

Vertical adjustment assembly 230 permits a user of rack assembly 200 to position first shelf 222 at a large number of locations along the vertical direction V, e.g., relative to second shelf 224. In particular, gears 240 can be placed at any suitable location, e.g., along the lateral direction L, on geared rack 232. Thus, gears 240 can be placed at any suitable location between first and second end portions 238 and 239 of geared rack 232 in order to select a position for first shelf 222 along the vertical direction V. In such a manner, vertical adjustment assembly 230 permits a user of rack assembly 200 to position first shelf 222 at a large number of locations along the vertical direction V.

It should be understood that the rack assembly 200 shown in FIGS. 3-9 is provided by way of example only. Thus, in various exemplary embodiments, rack assembly 200 can vary from the particular exemplary embodiment shown in FIGS. 3-9. For example, geared rack 232 can be mounted to first rack 222 with the other components of vertical adjustment assembly 230 adjusted accordingly.

In various exemplary embodiments, vertical adjustment assembly 230 can be self-catching. Thus, if a user drops first shelf 222 during adjustment, vertical adjustment assembly 230 can hinder first shelf 222 from dropping downwardly along the vertical direction V. In particular, if the user loses his or her grip on handle 272, handle 272 can drop downwardly, e.g., due to gravity, such that first and second gears 242 and 244 are meshed with each other and with geared rack 232 and first shelf 222 is supported and hindered from dropping downwardly along the vertical direction V.

In various exemplary embodiments, vertical adjustment assembly 230 can be constructed with materials for assisting rack assembly 200 with withstanding relatively high temperatures, such as temperatures within oven chamber 104 during cleaning operations of oven appliance 100. Thus, gears 240 and geared rack 232 can be constructed with a coating of graphite, molybdenum disulfide, or other similar material. Alternatively, gears 240 and geared rack 232 can be impregnated with graphite, molybdenum disulfide, etc. Such materials can assist with proper operation of vertical adjustment assembly 230 after exposure to relatively high temperatures, e.g., temperatures exceeding eight-hundred degrees Fahrenheit.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A rack assembly for an appliance, the rack assembly defining a lateral direction and a vertical direction, the lateral and vertical directions being perpendicular to each other, the rack assembly comprising:

a shelf for supporting food items and cooking utensils;

a geared rack that extends along the lateral direction;

a pair of gears positioned adjacent the geared rack, the gears meshing with each other and the geared rack;

an actuator assembly configured for selectively disengaging at least one gear of the pair of gears from the geared rack; and a support link extending between and coupling at least one of the pair of gears to the shelf.

2. The rack assembly of claim 1, further comprising a coupling link extending between and coupling the gears together such that the gears mesh with each other.

3. The rack assembly of claim 1, wherein the support link is rotatably mounted to the at least one of the pair of gears and to the shelf.

4. The rack assembly of claim 1, wherein the shelf is a first shelf, the rack assembly further comprising a second shelf spaced apart from the first shelf along the vertical direction, the geared rack mounted to the second shelf.

5. The rack assembly of claim 4, further comprising a slide assembly having a fixed portion and a sliding portion that is movable along the lateral direction relative to the fixed portion, the second shelf mounted to the sliding portion of the slide assembly.

6. The rack assembly of claim 1, further comprising a pair of bracing links and a mounting feature, the geared rack coupled to the mounting feature, the links of the pair of bracing links coupling the shelf to the mounting feature.

7. The rack assembly of claim 6, wherein the links of the pair of bracing links are rotatably mounted to the mounting feature and the shelf in order to couple the mounting feature to the shelf.

8. The rack assembly of claim 6, wherein the shelf is a first shelf and the mounting feature is a slide assembly, the rack assembly further comprising a second shelf spaced apart from the first shelf along the vertical direction, the geared rack mounted to the second shelf, the slide assembly having a fixed portion and a sliding portion that is movable along the lateral direction relative to the fixed portion, the second shelf mounted to the sliding portion of the slide assembly.

9. The rack assembly of claim 1, further comprising a clip mounted to the support link and coupling the support link to the shelf.

10. The rack assembly of claim 1, wherein the actuator assembly comprises:

a handle rotatably mounted to the shelf; and a connector link extending between and coupling the at least one gear of the pair of gears to the handle.

11. An appliance, the appliance defining a vertical direction, a lateral direction, and a transverse direction, the vertical, lateral, and transverse directions being mutually perpendicular, the appliance comprising:

a cabinet having interior walls that define a chamber, the interior walls of the cabinet including sidewalls spaced apart from each other along the transverse direction;

a shelf assembly positioned within the chamber of the cabinet, the shelf assembly comprising a support feature mounted to the cabinet at one of the sidewalls of the cabinet;

a geared rack mounted to the support feature, the geared rack extending along the lateral direction;

a pairs of gears positioned adjacent the geared rack, the gears meshing with each other and the geared rack;

an actuator assembly configured for selectively disengaging at least one of the pair of gears from the geared rack;

a shelf for supporting items thereon; and a support link coupling at least one of the pair of gears to the shelf.

12. The appliance of claim 11, wherein the shelf assembly further comprises a coupling link extending between and coupling the gears together such that the gears mesh with each other.

13. The appliance of claim 11, wherein the support link is rotatably mounted to the at least one of the pair of gears and to the shelf.

14. The appliance of claim 11, wherein the shelf is a first shelf, the shelf assembly further comprising a second shelf spaced apart from the first shelf along the vertical direction, the second shelf mounted to the support feature, the geared rack mounted to the second shelf.

15. The appliance of claim 14, wherein the support feature comprises a slide assembly having a fixed portion and a sliding portion that is movable along the lateral direction relative to the fixed portion, the second shelf mounted to the sliding portion of the slide assembly.

16. The appliance of claim 11, wherein the shelf assembly further comprises a pair of bracing links, the links of the pair of bracing links coupling the mounting feature to the shelf.

17. The appliance of claim 11, wherein the shelf assembly further comprises a clip mounted to the support link and coupling the support link to the shelf.

18. The appliance of claim 11, wherein the actuator assembly comprises:

a handle rotatably mounted to the shelf; and a connector link coupling at least one of the pair of gears to the handle.

19. A rack assembly for an appliance, the rack assembly defining a vertical direction and a lateral direction that are perpendicular to each other, the rack assembly comprising:

a shelf for supporting food items and cooking utensils; and a shelf adjustment assembly for supporting the shelf at various positions along the vertical direction, the shelf adjustment assembly comprising a geared rack that extends along the lateral direction;

a pair of gears positioned adjacent the geared rack, the gears meshing with each other and the geared rack; and an actuator assembly configured for selectively disengaging at least one of the pair of gears from the geared rack.

20. The rack assembly of claim 19, wherein the geared rack is mounted to the shelf.

* * * * *